US007675533B2

(12) United States Patent
Tamura et al.

(10) Patent No.: US 7,675,533 B2
(45) Date of Patent: Mar. 9, 2010

(54) THERMAL TRANSFER PRINTER FOR FILM

(75) Inventors: Yoshihiko Tamura, Tokyo-to (JP); Kenichi Aso, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 492 days.

(21) Appl. No.: 11/547,120

(22) PCT Filed: Mar. 30, 2005

(86) PCT No.: PCT/JP2005/006061

§ 371 (c)(1),
(2), (4) Date: Oct. 2, 2006

(87) PCT Pub. No.: WO2005/095110

PCT Pub. Date: Oct. 13, 2005

(65) Prior Publication Data

US 2008/0273074 A1 Nov. 6, 2008

(30) Foreign Application Priority Data

Mar. 30, 2004 (JP) ..... 2004-099811

(51) Int. Cl.
*B41J 31/00* (2006.01)

(52) U.S. Cl. ..... 347/213

(58) Field of Classification Search ..... 347/213, 347/215, 217–220, 171; 400/120.01, 611, 400/613

See application file for complete search history.

(56) References Cited

U.S. PATENT DOCUMENTS 5,179,390 A 1/1993 Yokoyama et al.
7,220,071 B2 * 5/2007 Baker et al. ..... 400/611

FOREIGN PATENT DOCUMENTS

| | | |
|---|---|---|
| EP | 1 211 082 A1 | 6/2002 |
| JP | 63-104862 A | 5/1988 |
| JP | 2-121862 | 5/1990 |
| JP | 2-121873 | 5/1990 |
| JP | 3-215045 | 9/1991 |
| JP | 3-215064 | 9/1991 |
| JP | 5-155076 | 6/1993 |
| JP | 6-122184 | 5/1994 |
| JP | 10-202993 | 8/1998 |
| JP | 11-170583 | 6/1999 |
| JP | 2001-180070 | 7/2001 |
| JP | 2003-127448 | 5/2003 |
| JP | 2003-154694 | 5/2003 |
| JP | 2003-154694 A | 5/2003 |

OTHER PUBLICATIONS

European Search Report: PCT/JP2005006061, Jun. 2009.

* cited by examiner

*Primary Examiner*—K. Feggins
(74) *Attorney, Agent, or Firm*—Ladas & Parry LLP

(57) ABSTRACT

A thermal transfer printer for film capable of thermal transfer printing on a plastic film. The thermal transfer printer for film is provided with a conveyance for conveying the plastic film along a predetermined path, an ink ribbon moving mechanism which includes a holder for holding a plurality of ink ribbons 11 and moves an ink ribbon selected arbitrarily from the plurality of ink ribbons to a print position arranged on the predetermined path, and a print head which prints on the plastic film by heating the ink ribbon moved to the print position.

6 Claims, 13 Drawing Sheets

| | CONDITION 1 | CONDITION 2 | CONDITION 3 | CONDITION 4 | CONDITION 5 | CONDITION 6 |
|---|---|---|---|---|---|---|
| PLATEN ROLLER DIAMETER (R) [mm] | 60 | 150 | 150 | 150 | 150 | 150 |
| CONTACT ANGLE ($\theta$) [deg.] | 90 | 120 | 120 | 180 | 180 | 270 |
| DYNAMIC FRICTION COEFFICIENT ($\mu$) | 0.75 | 0.6 | 0.75 | 0.6 | 0.75 | 0.75 |
| SHEAR IN PRINTING | OBSERVED | OBSERVED | UNOBSERVED | UNOBSERVED | UNOBSERVED | UNOBSERVED |

THERMAL TRANSFER PRINTER FOR FILM

TECHNICAL FIELD

The present invention relates to a thermal transfer printer which prints an image on a plastic film with a thermal transfer printing method.

RELATED ART

Conventionally, printing on a plastic film is performed with a screen printing method. In the screen printing method, a printing plate is produced according to the image to be printed, the number of colors, and the like, and the image is printed to a printing object using the printing plate. Therefore, when the image to be printed is changed or modified, it is necessary to produce a new printing plate.

A thermal transfer printing method is a printing method different from the screen printing method. In the thermal transfer printing method, an ink ribbon is heated with a thermal head so as to transfer ink on the ink ribbon to the printing object, thereby printing the image. Heating elements are provided in the thermal head, and a control device controls the operations of the heating elements so as to transfer the ink to a predetermined position on the printing object. Accordingly, the change and modification of the image to be printed can be processed by modifying process details of the control device. As for an apparatus for printing on a sheet with the above-mentioned thermal transfer printing method, an image recording apparatus is known (see Patent Document 1) which has a rotary ribbon unit accommodating thermal transfer ribbons, and heats the thermal transfer ribbons with the thermal head so as to record and form an image on the sheet. There are also patent documents 2 to 8 as earlier references relating to the present invention.

Patent Document 1: JP-A No. 2001-180070
Patent Document 2: JP-A No. 11-170583
Patent Document 3: JP-A No. 2-121862
Patent Document 4: JP-A No. 2-121873
Patent Document 5: JP-A No. 3-215045
Patent Document 6: JP-A No. 3-215064
Patent Document 7: JP-A No. 10-202993
Patent Document 8: JP-A No. 6-122184

DISCLOSURE OF THE INVENTION

Problem to be Solved by the Present Invention

However, in the conventional thermal transfer printing type image recording apparatus, printing on the plastic film is not considered.

Therefore, an object of the present invention is to provide a thermal transfer printer for film which can print an image on the plastic film with the thermal transfer printing method.

Means for Solving the Problem

In order to solve the above problem, the first thermal transfer printer for film of the present invention includes: conveyance means for conveying a plastic film along a predetermined path; an ink ribbon moving mechanism which includes holding means for holding ink ribbons, and moves an ink ribbon arbitrarily selected from the ink ribbons to a print position arranged on the predetermined path; and a print head which heats the ink ribbon to print on the plastic film moved to the print position.

According to the first thermal transfer printer for film of the present invention, the printing can be performed on the plastic film with the thermal transfer method using the ink ribbon arbitrarily selected from the plural ink ribbons. A plurality of holding means may hold the ink ribbons having different colors, such as cyan, magenta, yellow, and black, or the ink ribbons with the same color.

The first thermal transfer printer for film of the present invention may include: a platen roller which supports the ink ribbon and the plastic film from the opposite side of the print head; and a displacement preventing mechanism which brings the platen roller and the plastic film into close contact with each other such that the platen roller and the plastic film are not shifted from each other. Thus, the displacement between the plastic film and the print head can be prevented during the printing by bringing the plastic film into close contact with the platen roller. Accordingly, the displacement in printing can be prevented to thereby improve print accuracy and print quality.

In the first thermal transfer printer for film of the present invention, a pinch roller which presses the plastic film against the platen roller may be provided as the displacement preventing mechanism, and a contact angle θ between the plastic film and the platen roller, backward tension $T_1$ generated in the plastic film in the opposite direction of a conveyance direction of the conveyance means, forward tension $T_2$ generated in the plastic film in the conveyance direction of the conveyance means, average tension T ($=(T_1+T_2)/2$) of the backward tension $T_1$ and the forward tension $T_2$, a difference in tension ΔT ($=|T_1-T_2|/T$) between the backward tension $T_1$ and the forward tension $T_2$, force P with which the pinch roller presses the plastic film against the platen roller, and a dynamic friction coefficient μ between the platen roller and the plastic film may satisfy the following formula (1);

$$|2\mu T \sin(\theta/2)|+\mu P>T\times(1+\Delta T) \quad (1)$$

(where θ=0 deg. to 180 deg.).

In the formula (1), the left side indicates frictional force between the plastic film and the platen roller at a center point between the pinch rollers on a supply side and a winding side and at each portion where the pinch roller presses the plastic film, and the right side indicates force (slip force) which creates slip between the plastic film and the platen roller. Therefore, when the following formula (1) is satisfied, the slip can be prevented between the plastic film and the platen roller by the frictional force, so that the plastic film can be conveyed at a constant rotational speed of the platen roller. Accordingly, the displacement in printing can be prevented by keeping the printing speed constant.

For the plastic film wound over the platen roller, the contact angle θ shall mean an angle formed by a line connecting the center of the platen roller and a point at which the plastic film starts the contact with the platen roller and a line connecting the center of the platen roller and a point at which the plastic film is separated from the platen roller.

In the first thermal transfer printer for film of the present invention, as the contact angle θ between the plastic film and the platen roller is increased, the contact area is increased between the plastic film and the platen roller, so that the frictional force between the plastic film and the platen roller can be increased. Accordingly, it is desirable that the contact angle θ be set larger than 150 deg.

In the first thermal transfer printer for film of the present invention, the contact angle θ may be set larger than 180 deg. and a diameter of the platen roller may be larger than 100 mm. A length of the plastic film wound over the platen roller can be lengthened by increasing the diameter of the platen roller.

Therefore, the contact area between the plastic film and the platen roller is increased, thereby allowing the frictional force between the plastic film and the platen roller to be increased.

In order to solve the above problem, the second thermal transfer printer for film of the present invention includes: first conveyance means for conveying a plastic film; second conveyance means for conveying a transfer member along a predetermined path; an ink ribbon moving mechanism which includes holding means for holding ink ribbons, and moves an ink ribbon arbitrarily selected from the ink ribbons to a print position arranged on the predetermined path; a print head which prints on the transfer member by heating the ink ribbon moved to the print position; and a transfer mechanism which is arranged on a downstream side of the print position and transfers an image printed on the transfer member to the plastic film.

According to the second thermal transfer printer for film of the present invention, an image is printed on the transfer member and the image on the transfer member is transferred to the plastic film. Therefore, the image can be printed on the plastic film of a shape or material to which the image is hard to be printed directly from the thermal head.

The second thermal transfer printer for film of the present invention may include: a platen roller which supports the ink ribbon and the transfer member from the opposite side of the print head; and a displacement preventing mechanism which brings the platen roller and the transfer member into close contact with each other such that the platen roller and the transfer member are not displaced from each other. Thus, the displacement in printing can be prevented to improve the print accuracy and print quality by bringing the platen roller and the transfer member into close contact with each other.

In the second thermal transfer printer for film of the present invention, a pinch roller which presses the transfer member against the platen roller may be provided as the displacement preventing mechanism, and a contact angle $\theta_T$ between the transfer member and the platen roller, backward tension $T_{T1}$ generated in the transfer member in the opposite direction of a conveyance direction of the second conveyance means, forward tension $T_{T2}$ generated in the transfer member in the conveyance direction of the second conveyance means, average tension $T_T$ ($=(T_{T1}+T_{T2})/2$) of the backward tension $T_{T1}$ and the forward tension $T_{T2}$, a difference in tension $\Delta T_T$ ($=|T_{T1}-T_{T2}|/T$) between the backward tension $T_{T1}$ and the forward tension $T_{T2}$, force $P_T$ with which the pinch roller presses the transfer member against the platen roller, and a dynamic friction coefficient $\mu_T$ between the platen roller and the transfer member may satisfy the following formula (2):

$$|2\mu_T T_T \sin(\theta_T/2)|+\mu_T P_T > T_T \times (1+\Delta T_T) \quad (2)$$

(where $\theta_T$=0 deg. to 180 deg.).

In the formula (2), the left side indicates the frictional force between the transfer member and the platen roller at a center point between the pinch rollers on the supply side and the winding side and at each portion where the pinch roller presses the transfer members and the right side indicates the slip force between the transfer member and the platen roller. Therefore, when the following formula (2) is satisfied, the slip can be prevented between the transfer member and the platen roller, so that the displacement in printing can be prevented. For the transfer member wound over the platen roller, the contact angle $\theta_T$ shall mean an angle formed by a line connecting the center of the platen roller and a point at which the transfer member starts the contact with the platen roller and a line connecting the center of the platen roller and a point at which the transfer member is separated from the platen roller.

In the second thermal transfer printer for film of the present invention, as the contact angle $\theta_T$ between the transfer member and the platen roller is set larger, the contact area between the transfer member and the platen roller is increased, so that the frictional force between the transfer member and the platen roller can be increased. Accordingly, it is desirable that the contact angle $\theta_T$ be set larger than 150 deg.

In the second thermal transfer printer for film of the present invention, the contact angle $\theta_T$ may be set larger than 180 deg. and a diameter of the platen roller may be larger than 100 mm. A length of the transfer member wound over the platen roller can be lengthened by increasing the diameter of the platen roller. Therefore, the contact area between the transfer member and the platen roller is increased, thereby allowing the transfer member to be hardly shifted from the platen roller.

EFFECT OF THE INVENTION

According to the present invention, printing on a plastic film can be performed with a thermal transfer printing method, thus the printing plate is not required, and printing cost can be reduced. Furthermore, since printing is performed on a printing object with the print head in the thermal transfer printing method, printing details can be easily changed and modified by changing the process details of the control device which controls the print head.

BEST MODE FOR CARRYING OUT THE INVENTION

Figure 1:
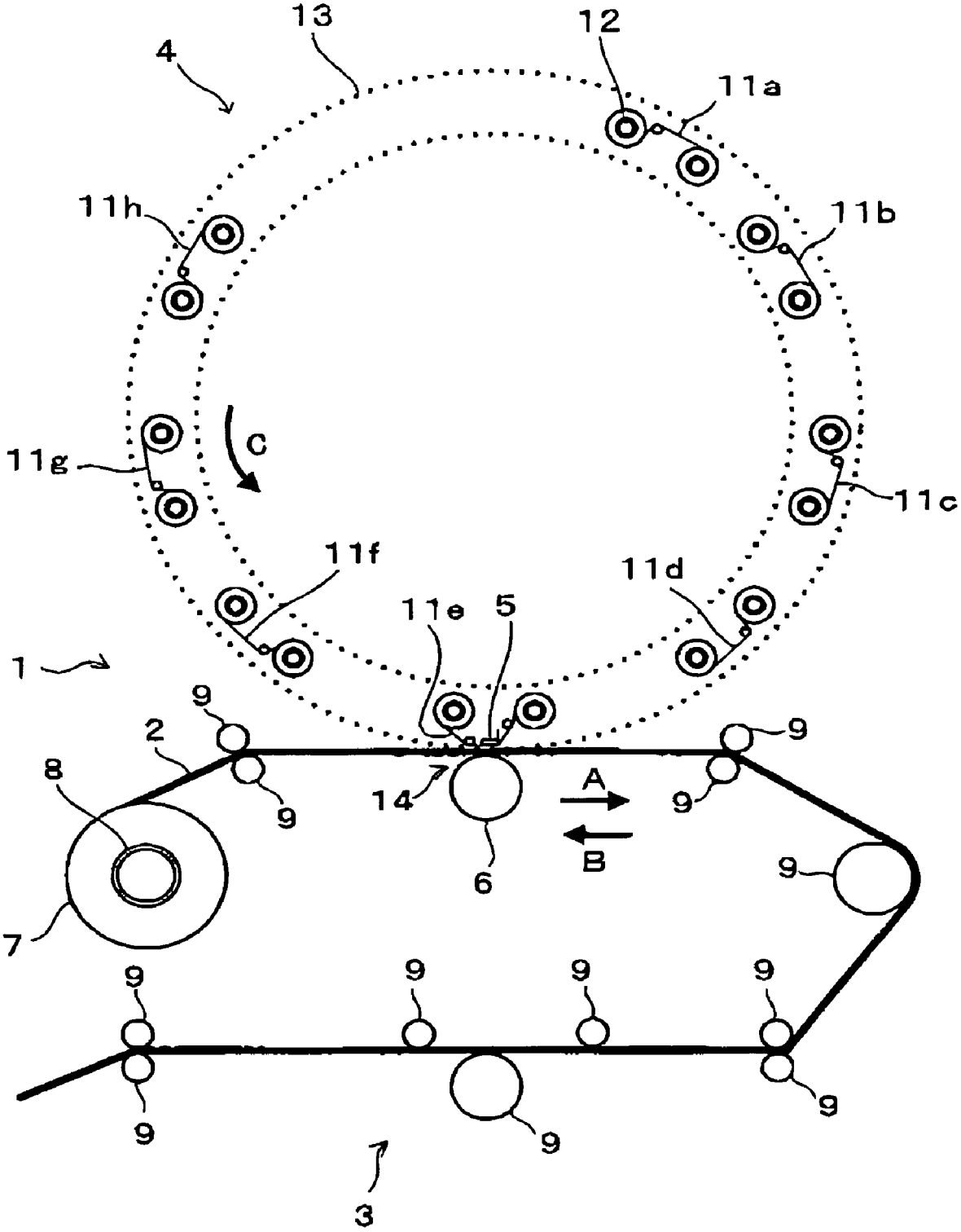
FIG. 1 is a view showing a main part of a thermal transfer printer for film according to an embodiment of the present invention.

FIG. 1 shows a main part of a thermal transfer printer for film according to an embodiment of the present invention. A printer 1 includes a film conveyance device 3 as conveyance means for conveying a plastic film 2 along a predetermined path, a rotary ink ribbon unit 4 as an ink ribbon moving mechanism, a thermal head 5 as a print head, and a platen roller 6. The film conveyance device 3 includes a roller holding mechanism 8 that holds a supply-side roller 7 for film 2, plural guide rollers 9 that guide the film 2 along a predetermined path, and a drive motor (not shown). The drive motor rotates a supply-side roller 7 and a winding-side roller 10 (not shown in FIG. 1) so as to convey the film 2 in directions of arrows A and B of FIG. 1. The rotary ink ribbon unit 4 includes a ribbon holding mechanism 12 as holding means for holding plural ink ribbons 11*a* to 11*h* (eight ink ribbons in FIG. 8), a frame 13, and a frame drive motor (not shown). Ribbon holding mechanisms 12 are attached to the frame 13. The frame drive motor rotates the frame 13 in a direction of an arrow C of FIG. 1 to move the arbitrarily selected ink ribbon 11 to a print position 14 where the thermal head 5 is arranged. The rotary ink ribbon unit 4 may be called 'Gatling type' ink ribbon unit. The well-known structure and operation of the thermal head can be adapted to the thermal head 5, thus the description thereof will be omitted.

Next, a procedure of printing on the film 2 in the printer 1 will be described.

First, the rotary ink ribbon unit 4 moves the arbitrarily selected ink ribbon, for example the ink ribbon 11*e*, to the print position 14. In parallel with this operation, the film conveyance device 3 conveys the film 2 along the predetermined path so as to move the print start position of a range (a print range) on the film 2 in which an image is firstly printed, to the print position 14.

Then, the thermal head 5 heats the ink ribbon 11*e* while pressing the ink ribbon 11*e* against the film 2 so as to transfer the ink of the ink ribbon 11*e* to the film 2. The platen roller 6 is arranged on the opposite side of the thermal head 5 so as to support the ink ribbon 11*e* and the film 2 during the ink transfer. The film conveyance device 3 moves the film 2 at a predetermined feed rate in the direction of the arrow A during the ink transfer with the thermal head 5. The image is printed on the film 2 after these operations.

When the film conveyance device 3 moves the film 2 to the print end position of the first print range, printing in the first print range is completed. Then, the film conveyance device 3 conveys the film 2 in the direction of the arrow A, and aligns the print start position of the next print range with the print position 14. After the alignment is completed, an image is printed in the next print range with the thermal head 5. Thus, images are sequentially printed on the film 2.

When inks are transferred plural times in the same print range, for example, in the color printing of an image, the film conveyance device 3 conveys the film 2 in the direction of the arrow B and aligns the print start position of the first print range with the print position 14 again, after the first printing in the first print range is completed. Then, when the printing is performed with an ink ribbon different from the ink ribbon 11*e* used in the first printing, the rotary ink ribbon unit 4 moves, e.g., the ink ribbon 11*f* which is an ink ribbon different from the ink ribbon 11*e* used in the first printing to the print position 14. Then, the thermal head 5 starts the second printing in the first print range. Thus, printings are performed predetermined times in the first print range. After the printings are performed predetermined times in the first print range, the print start position of the next print range is fed to the print position 14, and printings are similarly performed predetermined times in the next print range as the first print range. Inks can be transferred plural times in the same print ranges by performing these operations in sequence. Images are printed on the plastic film 2 with the above operation of the printer 1.

Figure 2:
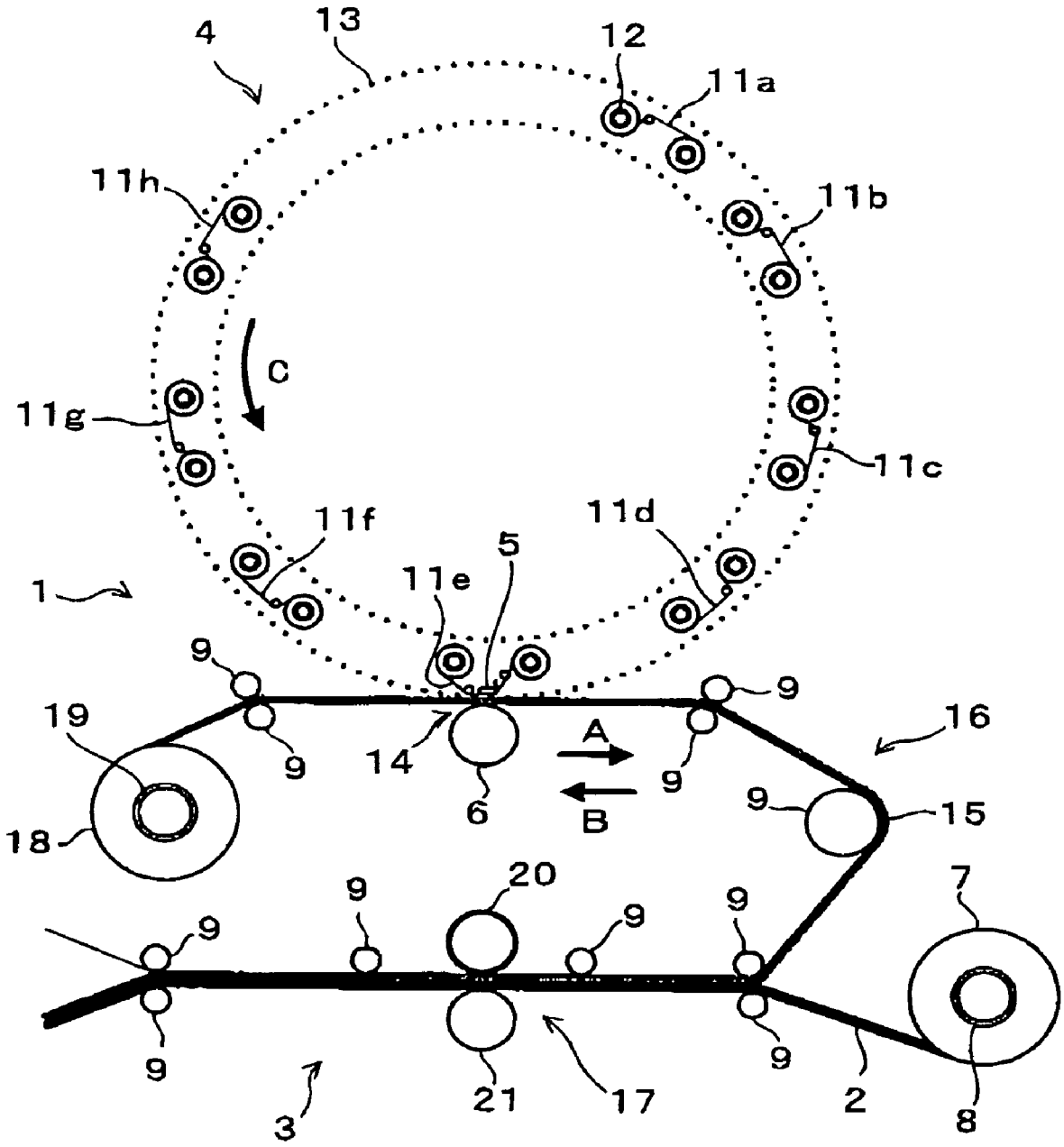
FIG. 2 is a view showing a main part of a thermal transfer printer for film according to another embodiment of the present invention.

FIG. 2 shows a main part of a thermal transfer printer for film according to another embodiment of the present invention. In the embodiment of FIG. 2, an image is printed on an intermediate transfer member, and then the image printed on the intermediate transfer member is transferred to a plastic film. In FIG. 2, the component in common with FIG. 1 is designated by the same numeral, and the description thereof will be omitted.

The printer 1 of FIG. 2 differs from the printer 1 of FIG. 1 in that the printer 1 of FIG. 2 further includes a transfer member conveyance device 16 which conveys an intermediate transfer member 15 along a predetermined path, and a transfer mechanism 17 which transfers the image printed on the intermediate transfer member 15 to the film 2. The transfer member conveyance device 16 includes a transfer member roller holding mechanism 119, guide rollers 9 and a drive motor (not shown). The transfer member roller holding mechanism 119 holds a transfer member supply-side roller 18 for the intermediate transfer member 15. The guide rollers 9 guide the intermediate transfer member 15 along the predetermined path. The drive motor rotates the transfer member supply-side roller 18 and a transfer member winding-side roller (not shown) to convey the intermediate transfer member 15 in the directions of arrows A and B of FIG. 2. The transfer mechanism 17 includes a heating roller 20 and a pressing roller 21. The heating roller 20 heats the intermediate transfer member 15 to transfer the image. The pressing roller 21 presses the intermediate transfer member 15 and the film 2 against the heating roller 20.

Next, a procedure of printing the image on the film 2 in the printer 1 of FIG. 2 will be described. The procedure of printing the image on the intermediate transfer member 15 is similar to the procedure of printing the image on the film 2 in the printer 1 of FIG. 1, so that the description thereof will be omitted. The intermediate transfer member 15 on which the image is printed is conveyed to the transfer mechanism 17. In the transfer mechanism 17, the heating roller 20 heats the film 2 and the intermediate transfer member 15 while the pressing roller 21 presses the film 2 and the intermediate transfer member 15, so that the image printed on the intermediate transfer member 15 is transferred to the film 2. According to these operations, the image is printed on the film 2.

Thus, an image can be printed on the film 2 of a shape or material on which the image is hard to be printed directly from the thermal head 5 by printing the image on the intermediate transfer member 15 and transferring the image to the film 2, as described above.

Then, FIGS. 3A, 3B and FIGS. 10A to 10E show other examples of the film conveyance device 3 in the present invention. In FIGS. 3A, 3B and FIGS. 10A to 10E, the component in common with FIGS. 1 and 2 is designated by the same numeral, and the description thereof will be omitted. In the film conveyance device 3 of FIG. 3A, the film 2 from the supply-side roller 7 is wound through the print position 14 directly into the winding-side roller 10 (the film 2 is conveyed in the sequence of I→II→the print position 14→III in FIG. 3A). When the film 2 is conveyed in the above-described manner, the guide rollers 9 can be omitted to simplify the conveyance mechanism. In the film conveyance device 3 of FIG. 3B, in order to bring the film 2 and the platen roller 6 into close contact with each other, the guide rollers 9 are arranged, for example, on a circumference GR shown in FIG. 3B and on the opposite side of the print position 14 with respect to the platen roller 6. In the film conveyance device 3 of FIG. 3B, the film 2 is conveyed in the sequence of I→II→III→the print position 14→IV→V. When the guide rollers 9 are thus arranged, the film 2 and the platen roller 6 are closely contacted with each other during the printing, so that displacement in printing can be prevented.

Figure 4A:
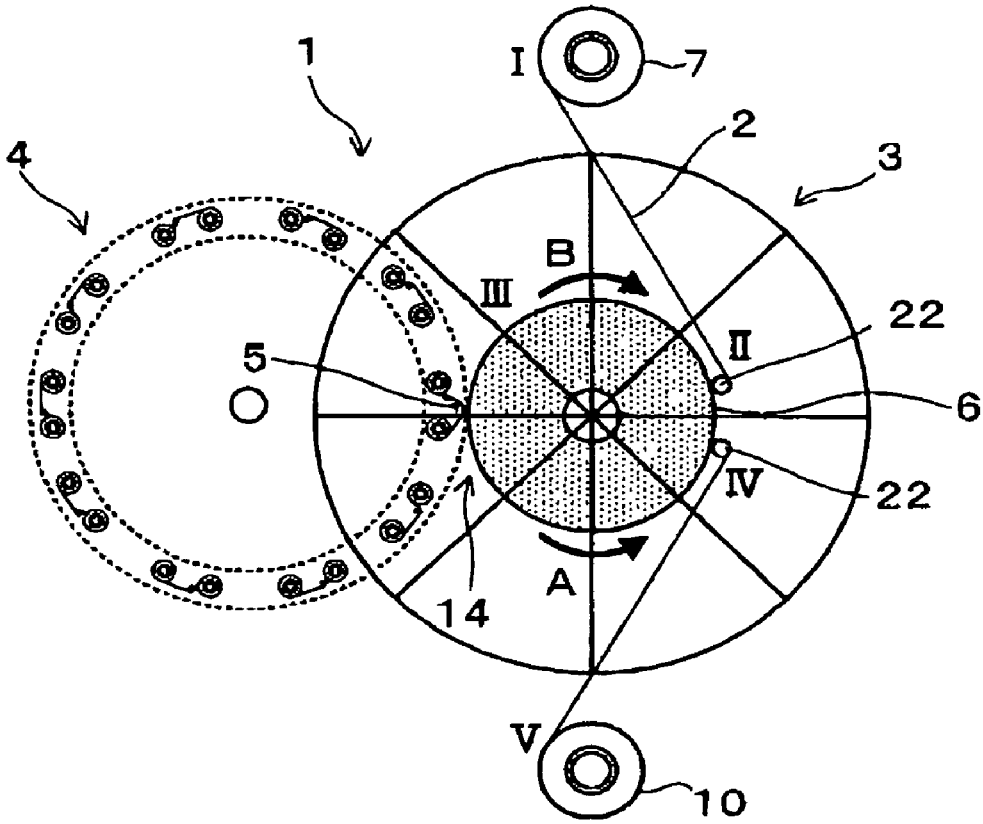
FIG. 4A is a view showing a second embodiment of the film conveyance device incorporated in the printer of the present invention.
Figure 4B:
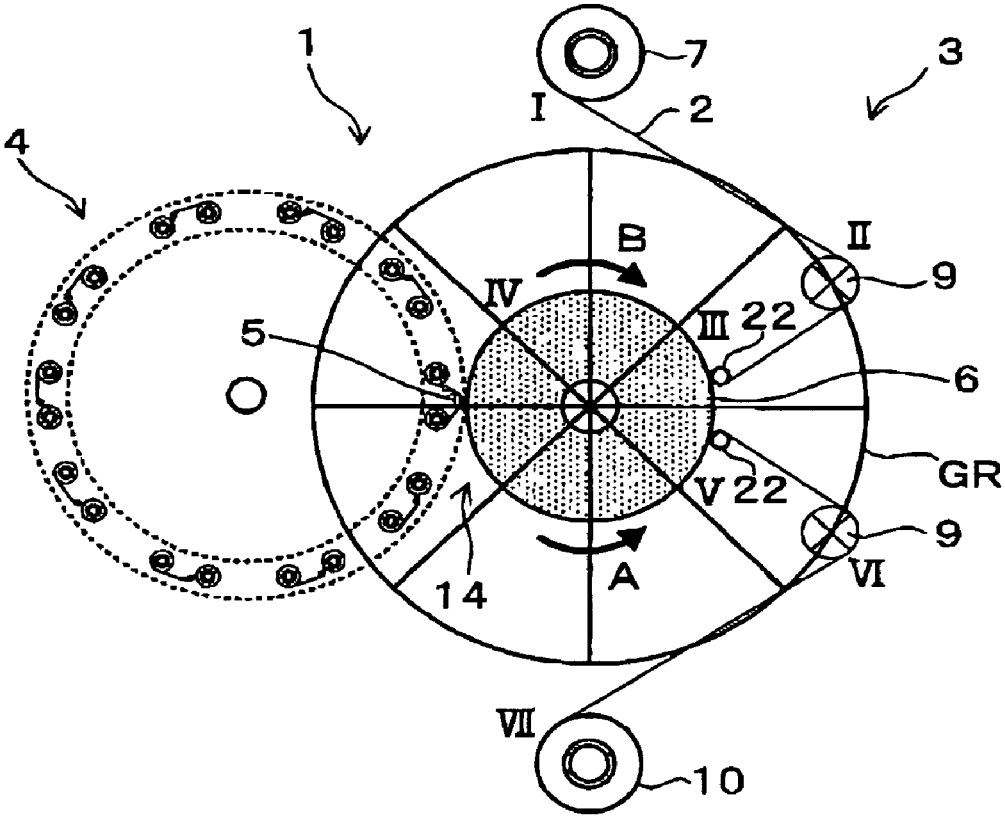
FIG. 4B is a view showing the second embodiment of the film conveyance device incorporated in the printer of the present invention.

The film conveyance device 3 of FIG. 4A includes pinch rollers 22 which bring the film 2 into close contact with the platen roller 6. In the film conveyance device 3 of FIG. 4A, the film 2 is conveyed in the sequence of I→II→III→the print position 14→IV→V. Thus, the film 2 and the platen roller 6 are contacted further closely with each other, when the film 2 is conveyed along the outer periphery of the platen roller 6, so that the displacement in printing can be prevented. As shown in FIG. 4B, when both the guide rollers 9 and the pinch rollers 22 are provided to the film conveyance device 3, the same effect as that of the film conveyance device 3 of FIG. 4A can be obtained. In the film conveyance device 3 of FIG. 4B, the film 2 is conveyed in the sequence of I→II→III→IV→the print position 14→V→VI→VII.

Figure 3A:
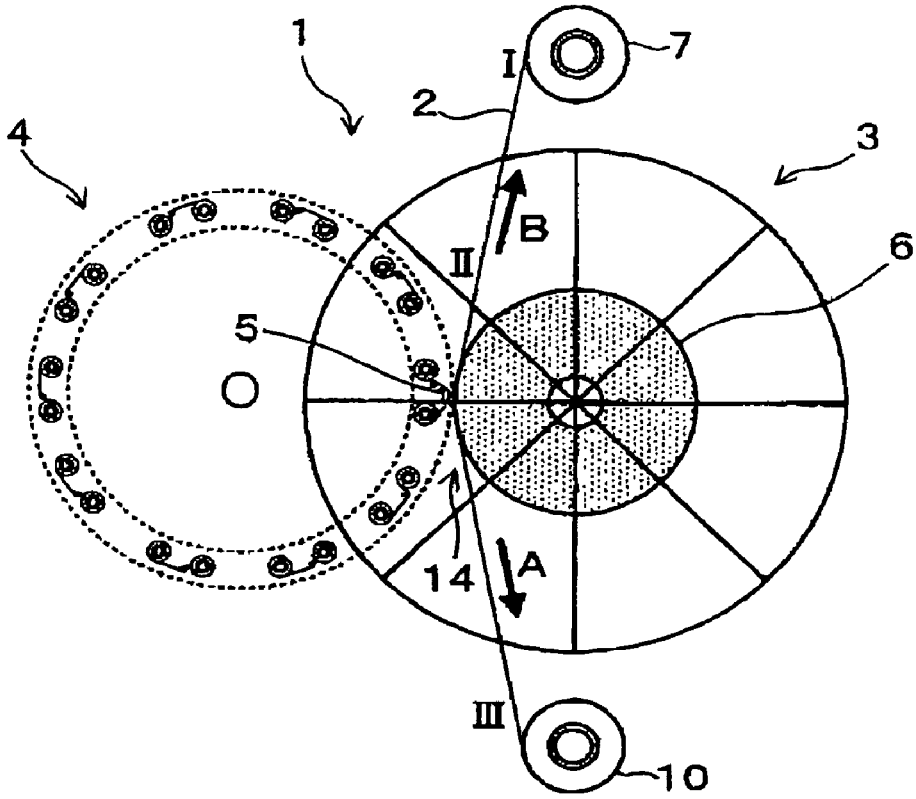
FIG. 3A is a view showing a first embodiment of a film conveyance device incorporated in the printer of the present invention.
Figure 3B:
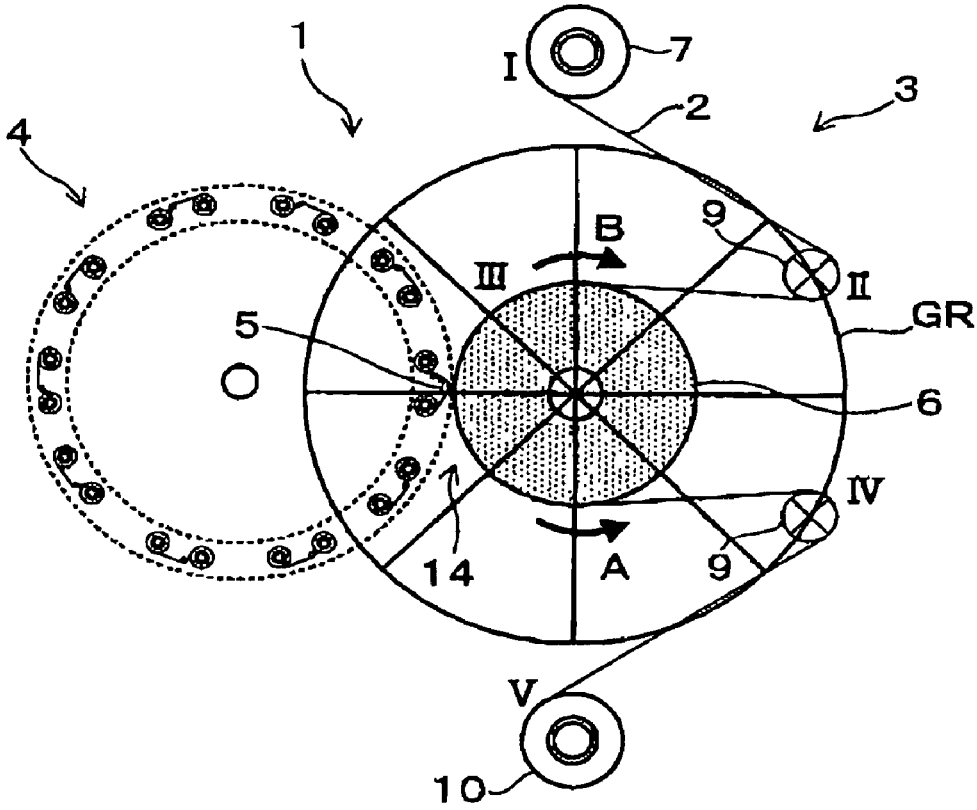
FIG. 3B is a view showing the first embodiment of the film conveyance device incorporated in the printer of the present invention.

In FIGS. 3B and 4B, the positions of the guide rollers 9 are not limited on the circumference GR, but the guide rollers 9 can freely be arranged on the position where the same effect as that described above is obtained.

Figure 5:
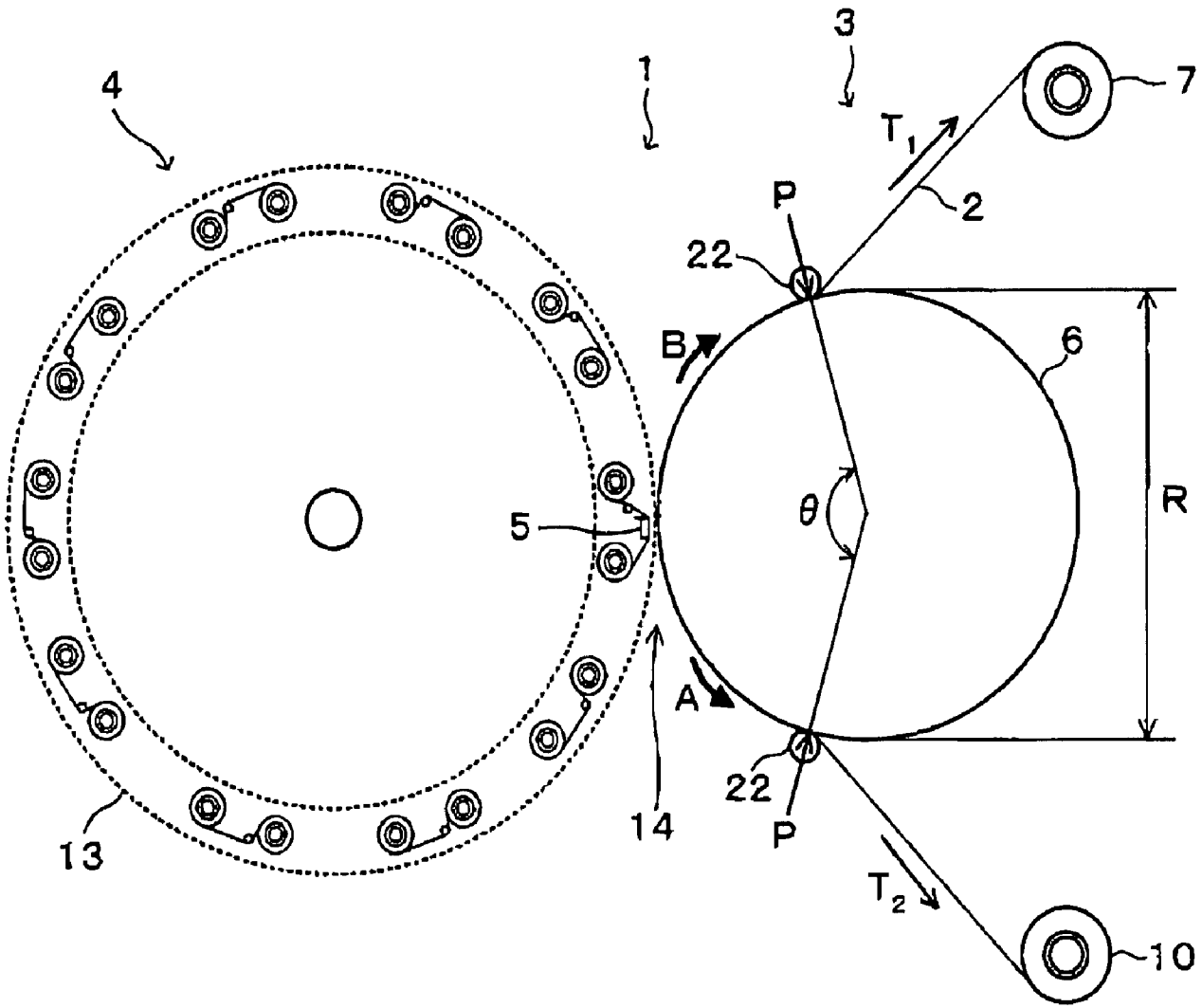
FIG. 5 is a view showing a third embodiment of the film conveyance device incorporated in the printer of the present invention.

In the printer 1 of FIG. 5, parameters of the film conveyance device 3 are set to satisfy the following formula (1).

$$|2\mu T\sin(\theta/2)|+\mu P>T\times(1+\Delta T) \quad (1)$$

(where θ=0 deg. to 180 deg.)

The meaning of each symbol in the formula (1) is as follows:

θ: contact angle between film 2 and platen roller 6;

μ: dynamic friction coefficient between film 2 and platen roller 6;

P: force with which pinch roller 22 presses film 2 against platen roller 6;

$T_1$: backward tension generated in film 2 in direction of arrow B of FIG. 5 (opposite direction of conveyance direction of film 2);

$T_2$: forward tension generated in film 2 in direction of arrow A of FIG. 5 (conveyance direction of film 2);

T (=$(T_1+T_2)/2$): averaged tension of backward tension $T_1$ and forward tension $T_2$; and ΔT (=$|T_1-T_2|/T$) tension difference between backward tension $T_1$ and forward tension $T_2$.

In the formula (1), the left side represents frictional force between the film 2 and the platen roller 6 at the center point between the pinch rollers 22 on the supply side (upper side of FIG. 5) and the winding side (lower side of FIG. 5) and at the pressing portion of the pinch roller 22, and the right side indicates the slip force between the film 2 and the platen roller 6, respectively. Therefore, since the slip between the film 2 and the platen roller 6 can be prevented as long as the formula (1) is satisfied, the film 2 can be conveyed constantly at the rotational speed of the platen roller 6. Accordingly, the displacement in printing can be prevented. In the printers 1 of FIGS. 3A to 3B and 4A to 4B, when the parameters of the film conveyance device 3 are set to satisfy the formula (1), the displacement in printing can be further prevented.

Figures 6, 7A:
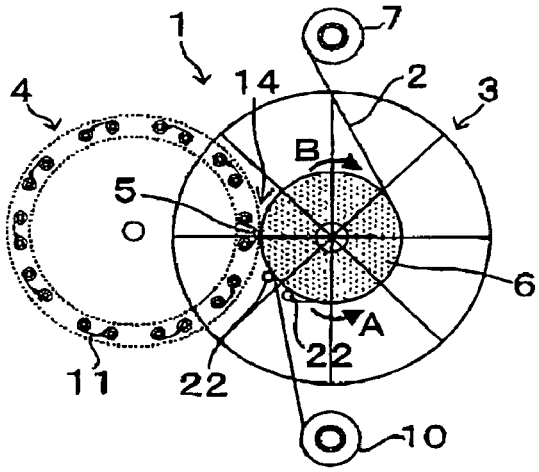
FIG. 6 is a view showing experimental results when the diameter, the contact angle and the dynamic friction coefficient of a platen roller 6 are varied in the film conveyance device 3 of FIG. 5.
FIG. 7A is a view showing a fourth embodiment of the film conveyance device incorporated in the printer of the present invention.

FIG. 6 shows an exemplary result of experiment of experimenting whether or not the displacement in printing is generated, with varying the diameter R of the platen roller 6, the contact angle θ, and the dynamic friction coefficient during the printing in the film conveyance device 3 of FIG. 5. In each condition, other parameters of the formula (1) except for the diameter R, the contact angle θ, and the dynamic friction coefficient μ are set to the same values. As is apparent from FIG. 6, the displacement in printing is eliminated when the contact angle θ is equal to or larger than 180 deg., and the displacement in printing can be eliminated even at 120 deg. by increasing the dynamic friction coefficient μ. The fewer displacement in printing is generated in case of the diameter R of 150 mm than in the case of the diameter R of 60 mm. This is attributed to that the winding length of the film 2 onto the platen roller 6 increases as the diameter R of the platen roller 6 increases, thereby increasing the contact area between the film 2 and the platen roller 6. Accordingly, the contact angle θ can be set larger than 150 deg. which is the midpoint between 120 deg. and 180 deg. so as to increase the frictional force, or the diameter R of the platen roller 6 can be set larger than 100 mm which is the substantially midpoint diameter between the diameters R of 60 mm and 150 mm so as to increase the contact area. Thus, the displacement in printing can be suppressed by setting the contact angle θ and the diameter R in the above-described manner.

The positions of the pinch rollers 22 are not limited to the positions shown in FIG. 5. The pinch rollers 22 can freely be arranged at the positions where the contact angle θ can be set such that the formula (1) is satisfied. The number of pinch rollers 22 is not limited to two. The pinch rollers 22 may be eliminated or one pinch roller 22 may be employed as long as the frictional force can be secured between the film 2 and the platen roller 6, for example, with the dynamic friction coefficient μ between the film 2 and the platen roller 6 (the left side exceeds the right side in the formula (1)). When the pinch rollers 22 are eliminated, the parameters are set to satisfy the following formula (1').

$$|2T\sin(\theta/2)|>T\times(1+\Delta T) \quad (1')$$

(where θ=0 deg. to 180 deg.)

The guide rollers 9 may be employed to the film conveyance device 3, when the contact angle θ with which the sufficient frictional force is ensured between the film 2 and the platen roller 6 cannot be set by using only the pinch rollers 22.

In the film conveyance device 3 of FIGS. 7A to 7E, the print range on the film 2 is fixed onto the outer periphery of the platen roller 6 by moving the pinch rollers 22 in accordance with the rotation of the platen roller 6. The film conveyance device 3 of FIGS. 7A to 7E differs from the film conveyance device 3 of FIG. 4A in this point. Since the pinch rollers 22 do not move in accordance with the rotation of the platen roller 6 in the film conveyance device 3 of FIG. 4A, the winding-side roller 10 winds the film 2 to move the film 2 during the printing. On the other hand, in the film conveyance device 3 of FIGS. 7A to 7E, the pinch rollers 22 move in accordance with the rotation of the platen roller 6, thus the film 2 is fixed onto the outer periphery of the platen roller 6. Therefore, in the film conveyance device 3 of FIGS. 7A to 7E, the film 2 moves during the printing through the rotation of the platen roller 6 in the direction of the arrow A of FIGS. 7A to 7E. In the film conveyance device 3 of FIGS. 7A to 7E, the film 2 is wound over the platen roller 6 along the same path as that of FIG. 4A in the state of FIG. 7C.

Next, the operation of the film conveyance device 3 of FIGS. 7A to 7E during the printing will be described. FIGS. 7A to 7E show the operations of the platen roller 6 and the pinch rollers 22 during the printing, in sequence. Before the printing is started, the pinch rollers 22 are fixed at the positions shown in FIG. 7C. Therefore, the winding-side roller 10 winds the film 2 so as to convey the first print range of the film 2 onto the outer periphery of the platen roller 6. After the winding-side roller 10 conveys the film 2, the platen roller 6 rotates in the direction of the arrow A of FIGS. 7A to 7E to align the print start position in the first print range of the film 2 with the print position 14. After the winding-side roller 10 conveys the film 2, the pinch rollers 22 are unfixed and move in the direction of the arrow B in accordance with the rotation of the platen roller 6. The film conveyance device 3 becomes in the state of FIG. 7A after these operations.

At the same time when the thermal head 5 starts printing, the platen roller 6 starts to rotate in the direction of the arrow A at a predetermined speed. The pinch rollers 22 also start to move in the direction of the arrow A in accordance with the rotation of the platen roller 6. During the printing, the platen roller 6 rotates in the direction of the arrow A in the sequence shown in FIG. 7B, FIG. 7C, FIG. 7D and FIG. 7E, and the pinch rollers 22 also move in accordance with the rotation of the platen roller 6. Since the rotation of the platen roller 6 is synchronized with the movements of the pinch rollers 22, the print range of the film 2 is fixed onto the outer periphery of the platen roller 6 during the printing. When the platen roller 6 rotates up to the position of FIG. 7E, the printing with the thermal head 5 is completed. After the printing, the film conveyance device 3 becomes in the state of FIG. 7C, the winding-side roller 10 conveys the film 2 so as to convey the next print range onto the outer periphery of the platen roller 6.

Figure 7B:
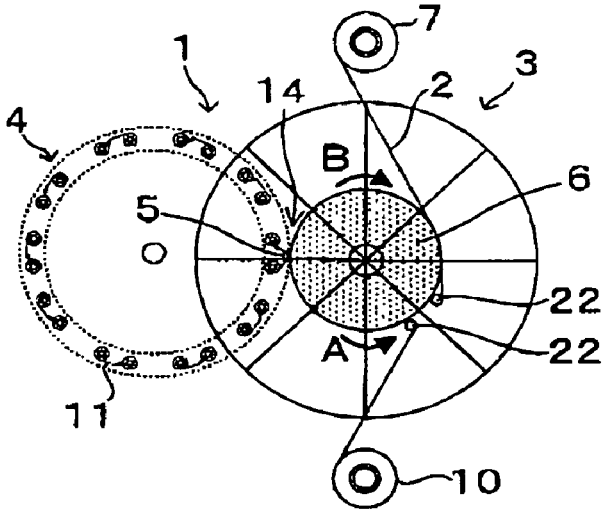
FIG. 7B is a view showing the fourth embodiment of the film conveyance device incorporated in the printer of the present invention.
Figure 7C:
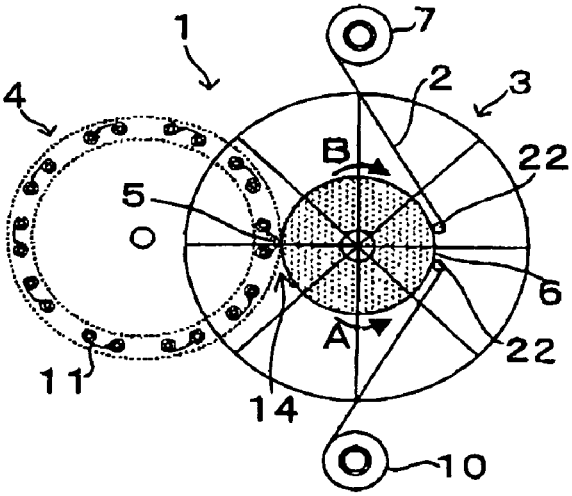
FIG. 7C is a view showing the fourth embodiment of the film conveyance device incorporated in the printer of the present invention.
Figure 7D:
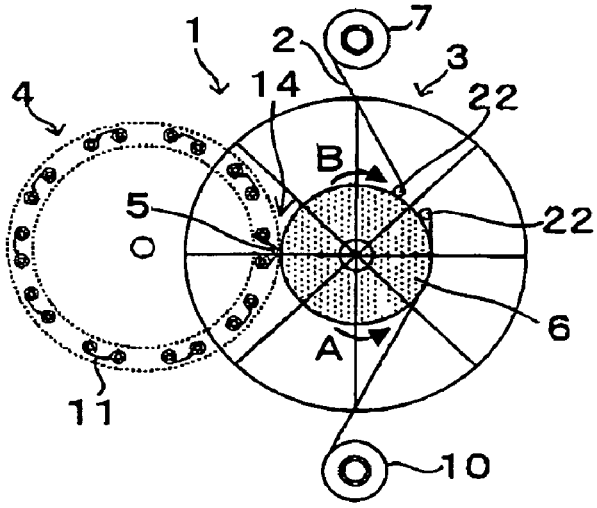
FIG. 7D is a view showing the fourth embodiment of the film conveyance device incorporated in the printer of the present invention.
Figure 7E:
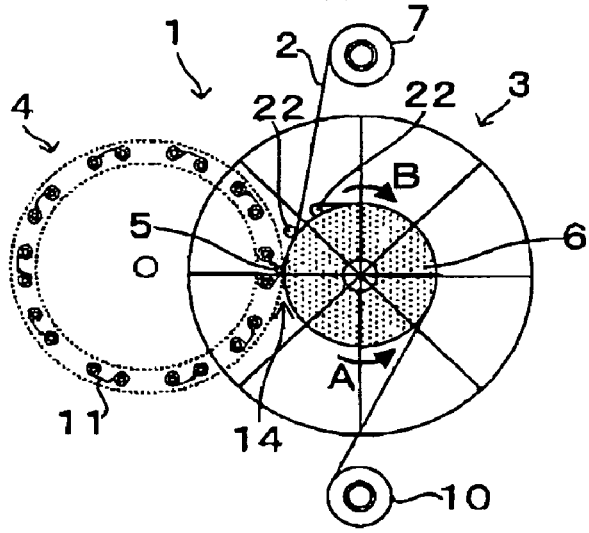
FIG. 7E is a view showing the fourth embodiment of the film conveyance device incorporated in the printer of the present invention.
Figure 8A:
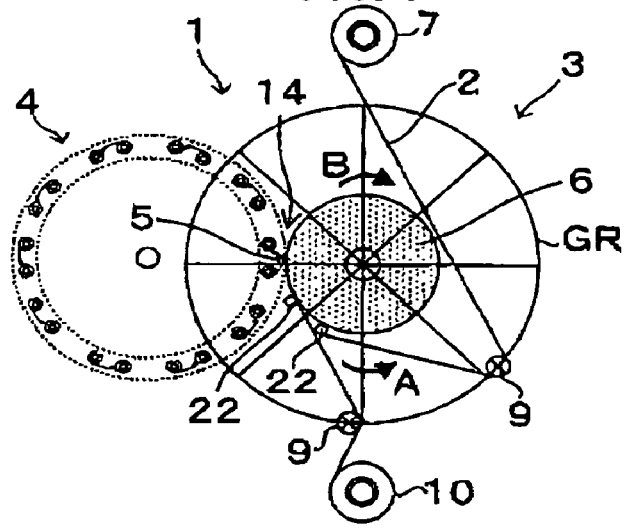
FIG. 8A is a view showing a fifth embodiment of the film conveyance device incorporated in the printer of the present invention.
Figure 8B:
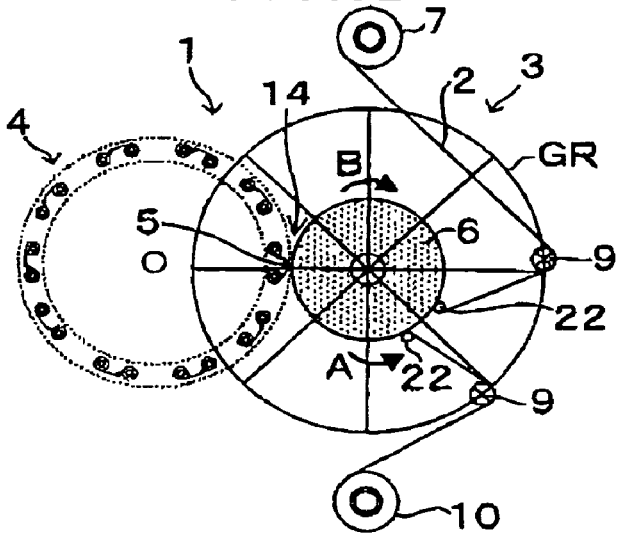
FIG. 8B is a view showing the fifth embodiment of the film conveyance device incorporated in the printer of the present invention.
Figure 8C:
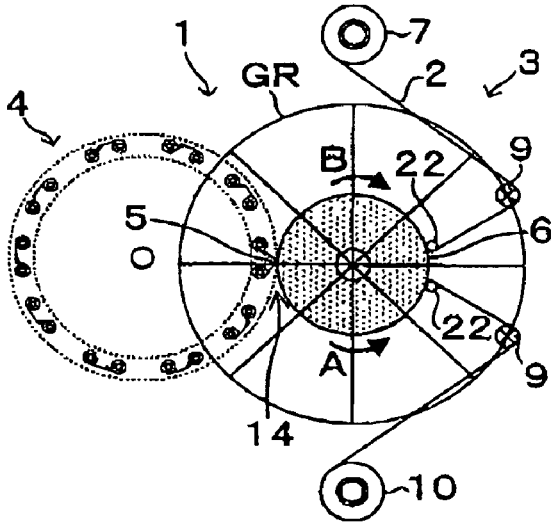
FIG. 8C is a view showing the fifth embodiment of the film conveyance device incorporated in the printer of the present invention.
Figure 8D:
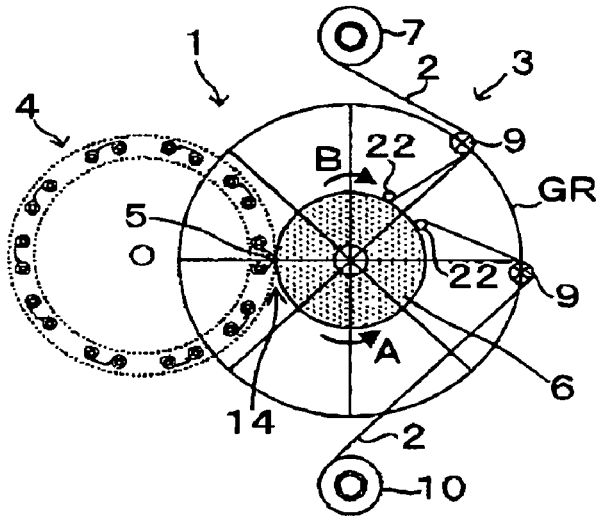
FIG. 8D is a view showing the fifth embodiment of the film conveyance device incorporated in the printer of the present invention.
Figure 8E:
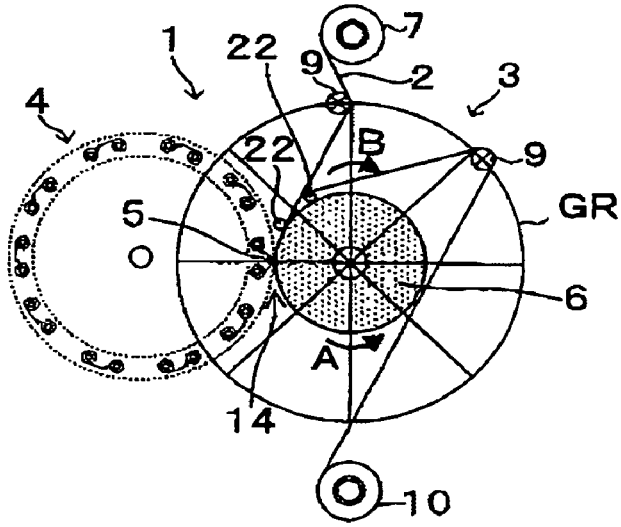
FIG. 8E is a view showing the fifth embodiment of the film conveyance device incorporated in the printer of the present invention.
Figure 9A:
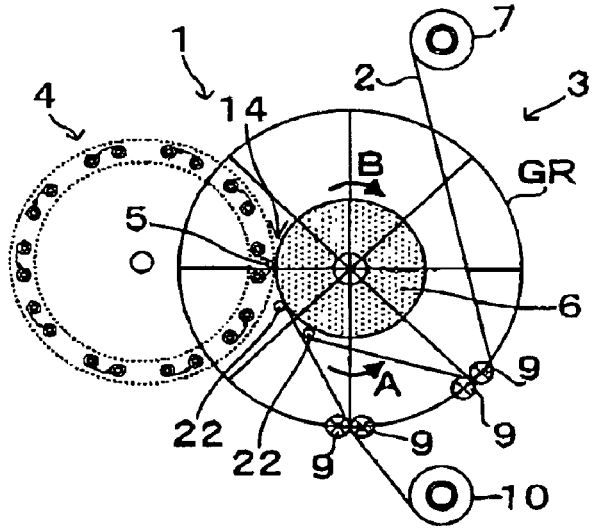
FIG. 9A is a view showing a sixth embodiment of the film conveyance device incorporated in the printer of the present invention.
Figure 9B:
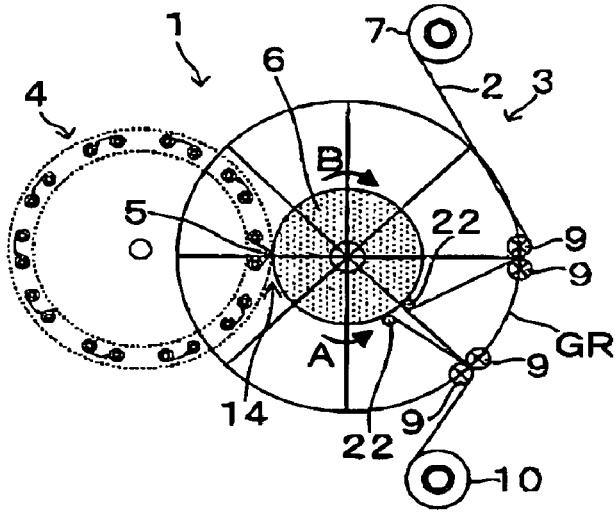
FIG. 9B is a view showing the sixth embodiment of the film conveyance device incorporated in the printer of the present invention.
Figure 9C:
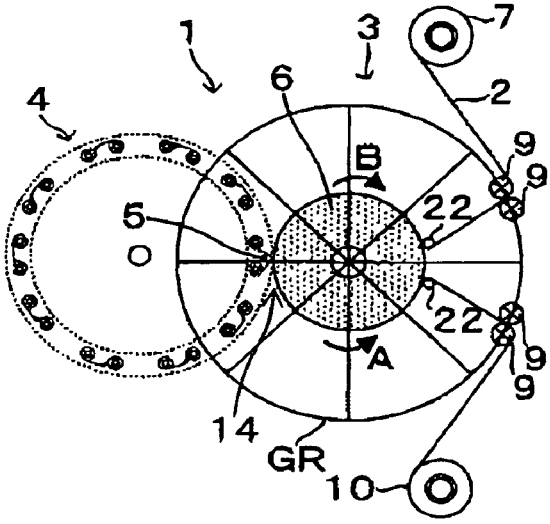
FIG. 9C is a view showing the sixth embodiment of the film conveyance device incorporated in the printer of the present invention.
Figure 9D:
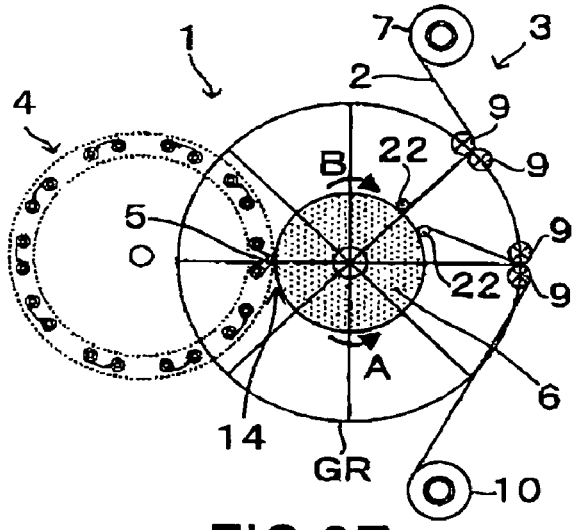
FIG. 9D is a view showing the sixth embodiment of the film conveyance device incorporated in the printer of the present invention.
Figure 9E:
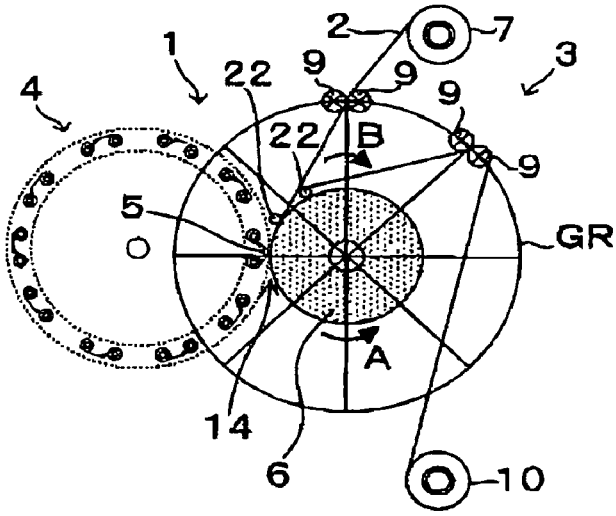
FIG. 9E is a view showing the sixth embodiment of the film conveyance device incorporated in the printer of the present invention.
Figure 10A:
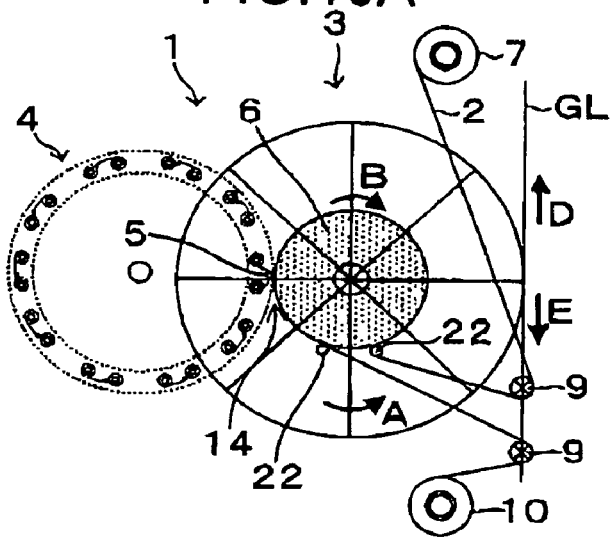
FIG. 10A is a view showing a seventh embodiment of the film conveyance device incorporated in the printer of the present invention.
Figure 10B:
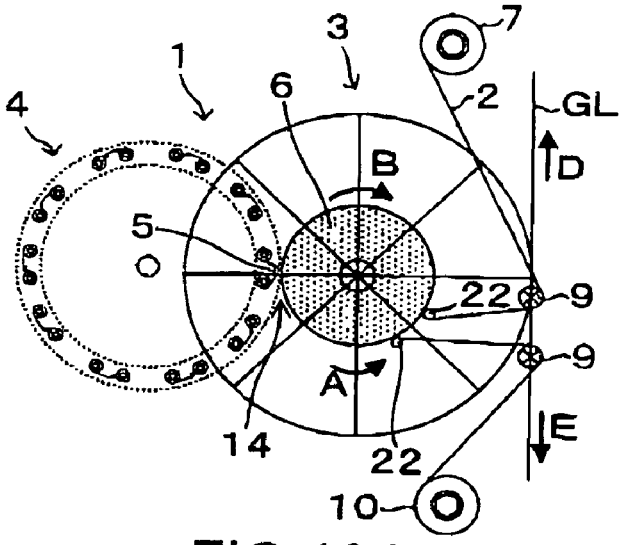
FIG. 10B is a view showing the seventh embodiment of the film conveyance device incorporated in the printer of the present invention.
Figure 10C:
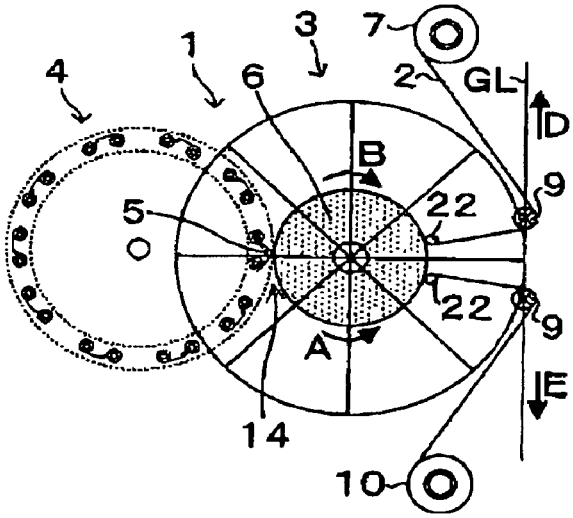
FIG. 10C is a view showing the seventh embodiment of the film conveyance device incorporated in the printer of the present invention.
Figure 10D:
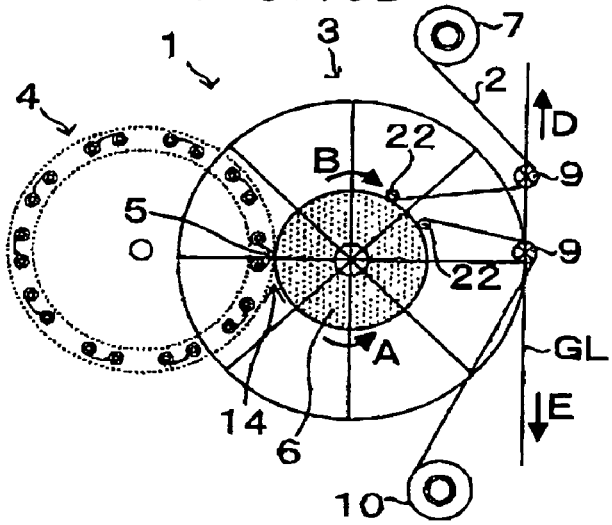
FIG. 10D is a view showing the seventh embodiment of the film conveyance device incorporated in the printer of the present invention.
Figure 10E:
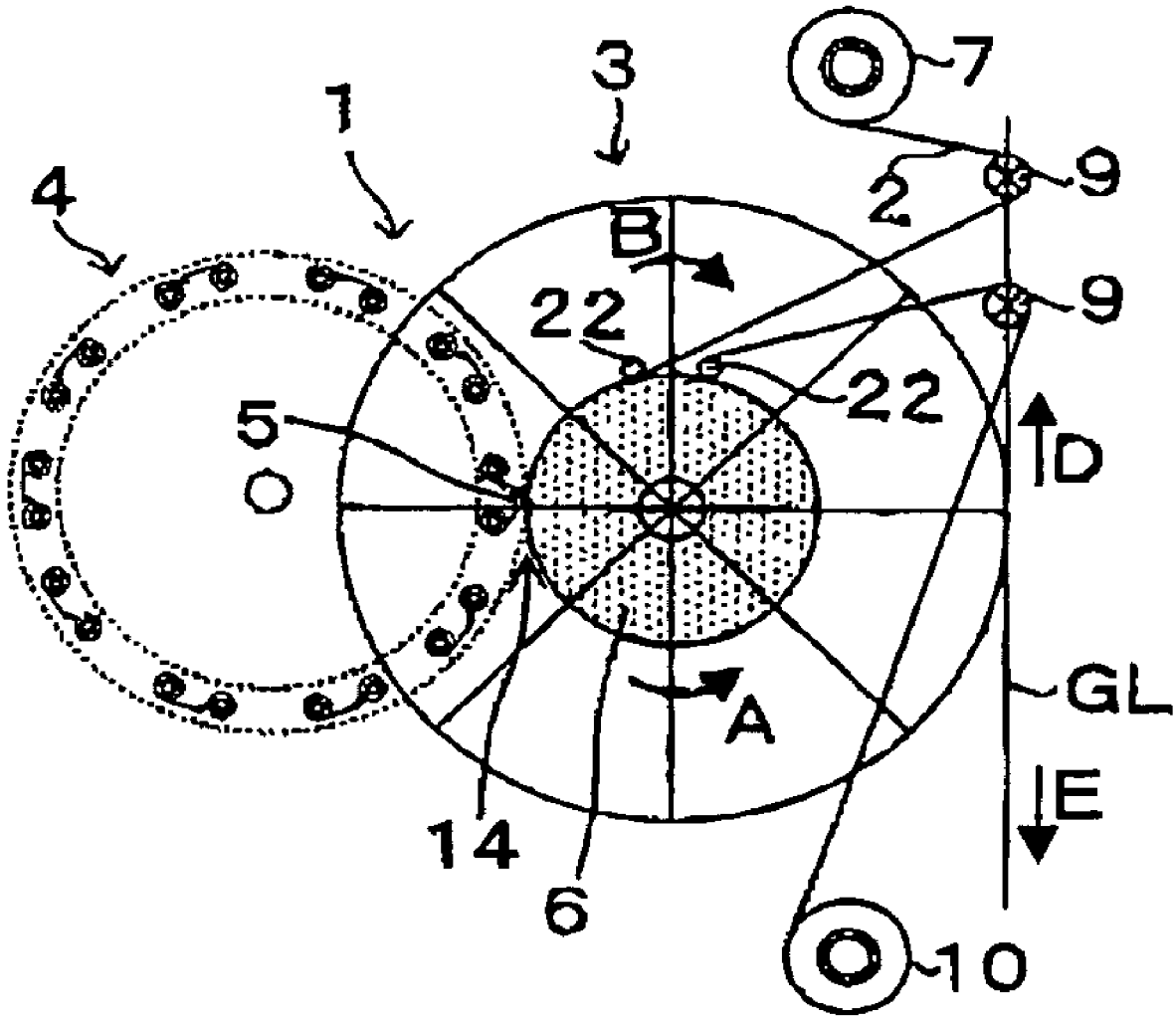
FIG. 10E is a view showing the seventh embodiment of the film conveyance device incorporated in the printer of the present invention.

In the case of printing plural times in the same print range, after the first printing is performed in the first print range, the pinch rollers 22 move in the direction of the arrow B while the platen roller 6 rotates in the direction of the arrow B from the state of FIG. 7E, and the print start position of the first print range is again aligned with the print position 14 (the film conveyance device 3 becomes in the state of FIG. 7A). During the operation, the movements of the pinch rollers 22 are synchronized with the rotation of the platen roller 6, so that the film conveyance device 3 becomes in the state of FIG. 7A from the state of FIG. 7E while the first print range of the film 2 is fixed onto the outer periphery of the platen roller 6. Then, when the ink ribbons 11 are changed, the printing is again performed in the first print range after the rotary ink ribbon unit 4 changes the ink ribbons 11. The printing can be performed plural times in the same print range by repeating the operations predetermined times.

Thus, the displacement in printing can be prevented by bringing the film 2 into close contact with and fixing it onto the outer periphery of the platen roller 6. In the case that inks are transferred plural times in the same print range in the overlapping manner, since the film 2 is fixed onto the outer periphery of the platen roller 6, the print start position of the print range can easily be aligned with the print position 14 by rotating the platen roller 6. Therefore, the displacement in printing in the same print range in the overlapping manner can be prevented, thereby improving the print accuracy and the print quality.

FIGS. 8A to 8E and FIGS. 10A to 10E show other examples of the film conveyance device 3 which includes the above-described displacement preventing mechanism to fix the film 2 onto the outer periphery of the platen roller 6 during the printing in a similar manner to that of FIGS. 7A to 7E. The film conveyance device 3 of FIGS. 8A to 8E differs from the film conveyance device 3 of FIGS. 7A to 7E in that the guide rollers 9 are arranged such that the film 2 do not contact with the film 2 itself during the printing and the guide rollers 9 move in accordance with the rotation of the platen roller 6 during the printing. The film 2 in the film conveyance device 3 of FIGS. 8A to 8E is wound over the platen roller 6 along the same path as that of FIG. 4B in the state of FIG. 8C.

FIGS. 8A to 8E show the operations of the platen roller 6, the pinch rollers 22 and the guide rollers 9 during the printing, in sequence. Since the operations of the platen roller 6 and the pinch rollers 22 are similar to those of the film conveyance device 3 of FIGS. 7A to 7E, the description will be omitted. Prior to printing, the guide rollers 9 are fixed at the positions shown in FIG. 8C until the conveyance of the film with the winding-side roller 10 is completed. After the conveyance of the film, the guide rollers 9 move in the direction of the arrow B to the positions shown in FIG. 8A on the circumference GR in accordance with the rotation of the platen roller 6. During the printing, the guide rollers 9 move in the direction of the arrow A on the circumference GR in the order of FIG. 8B, FIG. 8C, FIG. 8D and FIG. 8E. After the printing, the guide rollers 9 are fixed at the positions of FIG. 8C, and the winding-side roller 10 conveys the next print range onto the outer periphery of the platen roller 6. When the printing is performed plural times to the same print range in the overlapping manner, the film conveyance device 3 returns in the state of FIG. 8A from the state of FIG. 8E after the first printing is performed, and printing is again performed in the print range.

Thus, the film 2 can be prevented from contacting with the film 2 itself during the printing, when the guide rollers 9 are thus arranged. Thus, generation of static electricity, printing blur and the like caused by friction between the films 2 can be prevented.

The film conveyance device 3 of FIGS. 9A to 9E differs from the film conveyance device 3 of FIGS. 8A to 8E in that two guide rollers 9 are arranged at points shown in FIGS. 9A to 9E and the center of the platen roller 6 and the centers of the supply-side roller 7 and winding-side roller 10 are arranged to be positionally shifted from each other. The film 2 in the film conveyance device 3 of FIGS. 9A to 9E is wound over the platen roller 6 along the same path as that of FIG. 8C in the state of FIG. 9C. FIGS. 9A to 9E show the operations of the platen roller 6, the pinch rollers 22 and the guide rollers 9 during the printing, in sequence. The operations of the rollers 6, 9 and 22 are similar to those of the film conveyance device 3 of FIGS. 8A to 8E.

Thus, even if the center of the platen roller 6 and the centers of the supply-side roller 7 and the winding-side roller 10 are arranged to be positionally shifted from each other, the film 2 can be prevented from contacting with the film 2 itself during the printing, when the guide rollers 9 are thus arranged.

The film conveyance device 3 of FIGS. 10A to 10E differs from other film conveyance devices 3 in that the center of the platen roller 6 and the centers of the supply-side roller 7 and winding-side roller 10 are arranged to be positionally shifted from each other and the guide rollers 9 move in the directions of arrows D and E on the line GL shown in FIGS. 10A to 10E. The film 2 in the film conveyance device 3 of FIGS. 10A to 10E is wound over the platen roller 6 along the same path as that of FIG. 8C in the state of FIG. 10C.

FIGS. 10A to 10E show the operations of the platen roller 6, the pinch rollers 22 and the guide rollers 9 during the printing. The operations of the platen roller 6 and the pinch rollers 22 are similar to the operations of the film conveyance device 3 of FIGS. 7A to 7E. The conveyance operation of the film 2 which is performed by the winding-side roller 10 before starting the printing is similar to the operation of the film conveyance device 3 of FIGS. 8A to 8E. After completing the conveyance of the film 2, the platen roller 6 rotates in the direction of the arrow B so as to align the print start position of the first print range with the print position 14. The guide rollers 9 move in the direction of the arrows E on the line GL in accordance with the rotation of the platen roller 6. The film conveyance device 3 becomes in the state of FIG. 10A after these operations.

When the printing is started, the guide rollers 9 start the movements in the direction of the arrow D at a predetermined speed in accordance with the rotation of the platen roller 6 in the direction of the arrow A. During the printing, the guide rollers 9 move in the direction of the arrow D in the sequence shown in FIG. 10B, FIG. 10C, FIG. 10D and FIG. 10E. After the printing, the guide rollers 9 are fixed at the positions of FIG. 10C, and the winding-side roller 10 conveys the next print range onto the outer periphery of the platen roller 6. In the case of printing plural times in the same print range in the overlapping manner, the film conveyance device 3 returns in the state of FIG. 10E from the state of FIG. 10A after the first printing on the first print range is completed, and the printing is performed in the same print range again. Thus, the film 2 can be prevented from contacting with the film 2 itself during the printing, when the guide rollers 9 are arranged movable on the line GL as described above.

The guide rollers 9 and the pinch rollers 22A serve as the displacement preventing mechanism through the above-described operations.

The conveyance mechanisms of the film conveyance devices 3 of FIGS. 3A, 3B and FIGS. 10A to 10E are not limited to the conveyance of the film 2. For example, the conveyance mechanisms including the displacement preventing mechanism may be applied to the transfer member conveyance device 16 which conveys the intermediate transfer member 15. In this case, the displacement in the printing on the intermediate transfer member 15 can be prevented by bringing the intermediate transfer member 15 and the platen roller 6 into close contact with each other.

When the film conveyance device 3 of FIG. 5 conveys the intermediate transfer member 15, the parameters may be set to satisfy the following formula (2). When the parameters are adjusted to satisfy the following formula (2), $$|2\mu_T T_T \sin(\theta_T/2)|+\mu_T P_T > T_T \times (1+\Delta T_T) \quad (2)$$

(where $\theta_T$=0 deg. to 180 deg.)

The meaning of each symbol in the formula (2) is as follows:

$\theta_T$: contact angle between intermediate transfer member 15 and platen roller 6;

$\mu_T$: dynamic friction coefficient between intermediate transfer member 15 and platen roller 6;

$P_T$: force with which pinch rollers 22 press intermediate transfer member 15 against platen roller 6;

$T_{T1}$: backward tension generated in intermediate transfer member 15 in the opposite direction of a conveyance direction of intermediate transfer member 15;

$T_{T2}$: forward tension generated in intermediate transfer member 15 in conveyance direction of intermediate transfer member 15;

$T_T$ (=($T_{T1}$+$T_{T2}$)/2): average tension of backward tension $T_{T1}$ and forward tension $T_{T2}$; and $\Delta T_T$ (=|$T_{T1}$−$T_{T2}$|/$T_T$): difference in tension between backward tension $T_{T1}$ and forward tension $T_{T2}$.

In this case, the contact angle $\theta_T$ may also be set larger than 150 deg. so as to increase the frictional force between the intermediate transfer member 15 and the platen roller 6. The diameter of the platen roller 6 may be increased larger than 100 mm so as to increase the contact area between the intermediate transfer member 15 and the platen roller 6. When the pinch rollers 22 are eliminated, the parameters are set to satisfy the following formula (2').

$$|2\mu_T T_T \sin(\theta_T/2)| > T_T \times (1+\Delta T_T) \quad (2')$$

(where $\theta_T$=0 deg. to 180 deg.)

The present invention is not limited to the above embodiments, and may be realized in various configurations. For example, the rotating direction of the rotary ink ribbon unit is not limited to one direction. It is also not necessary that the rotary ink ribbon unit and the thermal head are arranged only on one side with respect to the printing object such as the plastic film and the intermediate transfer member. When the printing is performed on both sides of the printing object, the rotary ink ribbon units and the thermal heads may be arranged on both sides of the printing object, respectively.

The invention claimed is:

1. A thermal transfer printer for film, comprising:

conveyance means for conveying a plastic film along a predetermined path;

an ink ribbon moving mechanism which includes holding means for holding a plurality of ink ribbons, moves an ink ribbon arbitrarily selected from the plurality of ink ribbons to a print position arranged on the predetermined path;

a print head which prints on the plastic film by heating the ink ribbon moved to the print position;

a platen roller which supports the ink ribbon and the plastic film from an opposite side of the print head;

a displacement preventing mechanism which brings the platen roller and the plastic film into close contact with each other such that the platen roller and the plastic film are not displaced from each other;

wherein a pinch roller which presses the plastic film against the platen roller is provided as the displacement preventing mechanism; and a contact angle θ between the plastic film and the platen roller, backward tension $T_1$ generated in the plastic film in an opposite direction of a conveyance direction of the conveyance means, forward tension $T_2$ generated in the plastic film in the conveyance direction of the conveyance means, average tension $T$ $(=(T_1+T_2)/2)$ of the background tension $T_1$ and the forward tension $T_2$, a difference in tension $\Delta T$ $(=|T_1-T_2|/T)$ between the backward tension $T_1$ and the forward tension $T_2$, force P with which the pinch roller presses the plastic film against the platen roller, and a dynamic friction coefficient μ between the platen roller and the plastic film satisfy the following formula (1):

$$|2\mu T \sin(\theta/2)|+\mu P>Tx(1+\Delta T) \quad (1)$$

(where θ=0 deg. to 180 deg.).

2. The thermal transfer printer for film according to claim 1, wherein the contact angle θ is set larger than 150 deg.

3. The thermal transfer printer for film according to claim 1, wherein the contact angle θ is set larger than 180 deg. and a diameter of the platen roller is larger than 100 mm.

4. A thermal transfer printer for film comprising:

first conveyance means for conveying a plastic film;

second conveyance means for conveying a transfer member along a predetermined path;

an ink ribbon moving mechanism which includes holding means for holding a plurality of ink ribbons, and moves and ink ribbon arbitrarily selected from the plurality of ink ribbons to a print position arranged on the predetermined path;

a print head which prints on the transfer member by heating the ink ribbon moved to the print position;

a transfer mechanism which is arranged on a downstream side of the print position and transfers an image printed on the transfer member to the plastic film, a platen roller which supports the ink ribbon and the transfer member from an opposite side of the print head; and a displacement preventing mechanism which brings the platen roller and the transfer member into close contact with each other such that the platen roller and the transfer member are not displaced from each other, wherein a pinch roller which presses the transfer member against the platen roller is provided as the displacement preventing mechanism; and a contact angle $\theta_T$ between the transfer member and the platen roller, background tension $T_{T1}$ generated in the transfer member in the opposite direction of a conveyance direction of the second conveyance means, forward tension $T_{T2}$ generated in the transfer member in the conveyance direction of the second conveyance means, average tension $T_T(=(T_{T1}+T_{T2})/2)$ of the backward tension $T_{T1}$ and the forward tension $T_{T2}$, a difference in tension $\Delta T_T(=|T_{T1}-T_{T2}|/T)$ between the backward tension $T_{T1}$ and the forward tension $T_{T2}$, force $P_T$ with which the pinch roller presses the transfer member against the platen roller, and a dynamic friction coefficient $\mu_T$ between the platen roller and the transfer member satisfy the following formula (2):

$$|2\mu_T \sin(\theta_T/2)|+\mu_T P_T>T_T x(2+\Delta T_T) \quad (2)$$

(where $\theta_T$=0 deg. to 180 deg.).

5. The thermal transfer printer for film according to claim 4 wherein the contact angle $\theta_T$ is set larger than 150 deg.

6. The thermal transfer printer for film according to claim 4, wherein the contact angle $\theta_T$ is set larger than 180 deg. and a diameter of the platen roller is larger than 100 mm.

* * * * *